US007854633B2

(12) United States Patent
Lynch et al.

(10) Patent No.: US 7,854,633 B2
(45) Date of Patent: Dec. 21, 2010

(54) LOW PROFILE PLUG RECEPTACLE

(75) Inventors: Stephen Brian Lynch, Portola Valley, CA (US); Anthony Sagala Montevirgen, Milpitas, CA (US)

(73) Assignee: Apple Inc., Cupertino, CA (US)

( * ) Notice: Subject to any disclaimer, the term of this patent is extended or adjusted under 35 U.S.C. 154(b) by 118 days.

(21) Appl. No.: 12/205,333

(22) Filed: Sep. 5, 2008

(65) Prior Publication Data

US 2010/0062656 A1 Mar. 11, 2010

(51) Int. Cl.
*H01R 24/04* (2006.01)

(52) U.S. Cl. ..... 439/669

(58) Field of Classification Search ..... 439/669, 439/95, 101, 939, 607.43
See application file for complete search history.

(56) References Cited

U.S. PATENT DOCUMENTS 6,461,199 B1 10/2002 Koga et al.
6,592,408 B2 * 7/2003 Ma et al. ..... 439/669
7,217,163 B2 * 5/2007 Landgraf ..... 439/669
2002/0037669 A1 * 3/2002 D'Addario ..... 439/669
2002/0193006 A1 * 12/2002 Ma et al. ..... 439/669
2007/0178771 A1 8/2007 Goetz et al.
2009/0149081 A1 6/2009 Zhu et al.

FOREIGN PATENT DOCUMENTS

JP 04-118879 A 4/1992
WO WO 2009/091495 A2 7/2009

OTHER PUBLICATIONS

U.S. Appl. No. 12/708,468, filed Feb. 18, 2010, Dabov et al.

* cited by examiner

*Primary Examiner*—Jean F Duverne
(74) *Attorney, Agent, or Firm*—Townsend and Townsend and Crew LLP

(57) ABSTRACT

A low profile receptacle plug receptacle is disclosed. The low profile plug receptacle which may have a housing with a partially circular opening that is configured in one embodiment to receive a cylindrical plug. The low profile receptacle plug receptacle may have a second opening which has a width smaller than the diameter of the cylindrical plug. A portion of the cylindrical plug may extend past the second opening when inserted into the housing. The low profile receptacle plug receptacle may part of an electronic device.

29 Claims, 5 Drawing Sheets

LOW PROFILE PLUG RECEPTACLE

FIELD OF INVENTION

The present invention relates generally to connector receptacles such as audio jacks and in particular to low profile plug receptacles and electronic devices using low profile plug receptacles.

BACKGROUND OF THE INVENTION

Standard audio connectors or plugs are available in three sizes according to the outside diameter of the plug: a 6.35 mm (¼") plug, a 3.5 mm (⅛") miniature plug and a 2.5 mm (3/32") subminiature plug. The plugs include multiple conductive regions in distinct portions of the plug such as the tip, sleeve and one or more middle portions between the tip and sleeve and are thus often referred to as TRS (tip, ring and sleeve) connectors.

FIGS. 1A and 1B illustrate examples of audio plugs 10 and 20 having three and four conductive portions, respectfully. As shown in FIG. 1A, plug 10 includes a conductive tip 12, a conductive sleeve 14 and a conductive ring 16 electrically isolated from the tip 12 and the sleeve 14 by insulating rings 17 and 18. Plug 20, shown in FIG. 1B, includes a conductive tip 22, a conductive sleeve 24 and two conductive rings 25, 26 electrically isolated by insulating rings 27, 28 and 29. When plugs 10 and 20 are 3.5 mm miniature connectors, the outer diameter of sleeve 14, 24 and conductive rings 16, 25, 26 is 3.5 mm.

A standard receptacle or "jack" used to connect an audio plug, such as plug 10 or 20, to an electronic device includes an opening through which the plug is inserted that has an interior diameter sized to receive the plug. Taking into account the thickness of the housing in which the opening is formed as well as an appropriate amount of clearance for the plug to slide into the receptacle, a standard receptacle for a 3.5 mm audio plug has a thickness that is greater than 3.5 mm. As electronic devices get thinner, the diameter of the audio plug, and corresponding receptacle, have been found to be limiting factors in reduction of device thickness. While it is possible to develop plugs that are thinner than either the 3.5 mm miniature or 2.5 mm subminiature audio plugs that could be used with a correspondingly thinner receptacle, smaller connectors are not backward compatible and need to use an adapter for larger jacks.

BRIEF SUMMARY OF THE INVENTION

The present invention relates to audio plug receptacles having a thickness or height that is less than an outside diameter of an audio plug intended to be used with the plug receptacle. In one embodiment a low profile plug receptacle is provided that includes a connector housing with at least a front side and a bottom side, the front side including a partially circular opening which extends into a longitudinal passage inside the connector housing, the bottom side including a second opening which extends into the longitudinal passage, the second opening having a width which is smaller than the diameter of the partially circular opening, the connector housing being compatible with an elongated cylindrical plug which extends partially through the second opening when inserted into the connector housing, and a plurality of plug receptacle contacts within the longitudinal passage.

In some embodiments the plug receptacle may include a flexible housing which at least partially covers the second opening. The flexible housing may elastically deform expanding outward when the elongated cylindrical plug is inserted into the longitudinal passage. In other embodiments the plug receptacle may include a hinged housing which at least partially covers the second opening and hinges away from the longitudinal passage when the elongated cylindrical plug is inserted into the longitudinal passage. In various embodiments the hinged housing may either elastically deform at a hinged region when the elongated cylindrical plug is inserted into the longitudinal passage or hinge at a mechanical hinge. In still other embodiments the plug receptacle further includes an outer housing having a portion that at least partially surrounds the second opening which is sufficiently flexible to allow the elongated cylindrical plug to be snapped in and out through the second opening.

Yet another embodiment of the invention may include a portable electronic device, including a device housing including a front side, top side, and a bottom side, the front side including a partially circular opening which extends into a longitudinal passage inside the device housing, the bottom side including a second opening which extends into the longitudinal passage, the second opening having a width which is smaller than the diameter of the partially circular opening, the connector housing being compatible with an elongated cylindrical plug which extends partially through the second opening when inserted into the longitudinal passage, a plurality of plug receptacle contacts within the longitudinal passage; and a display panel on the top side of the housing, wherein a portion of the display panel is vertically stacked inline with the plurality of plug receptacles.

Yet another embodiment of the invention may include a low profile plug receptacle for a 3.5 mm audio plug, the receptacle including a connector housing including at least a front side and a bottom side, the front side including a partially circular opening which extends into a longitudinal passage inside the connector housing, the partially circular opening having a height between a furthest point on an interior perimeter of the opening and the bottom side less than 3.5 mm, the bottom side including a second opening which extends into the longitudinal passage, the second opening having a width which is smaller than the diameter of the partially circular opening, the connector housing being compatible with a 3.5 mm audio plug which extends partially through the second opening when inserted into the longitudinal passage of the connector housing, a plurality of plug receptacle contacts within the longitudinal passage, the plurality of plug receptacle contacts comprising a ground contact, first and second audio contacts and a video contact, and a flexible door which at least partially covers the second opening and opens away from the longitudinal passage by insertion of the 3.5 mm audio plug into the longitudinal passage and closes toward the longitudinal passage when the 3.5 mm audio plug is removed.

To better understand the nature and advantages of the invention, reference should be made to the following description and the accompanying figures. It is to be understood, however, that each of the figures is provided for the purpose of illustration only and is not intended as a definition of the limits of the scope of the present invention.

DETAILED DESCRIPTION OF THE INVENTION

Figure 1A:
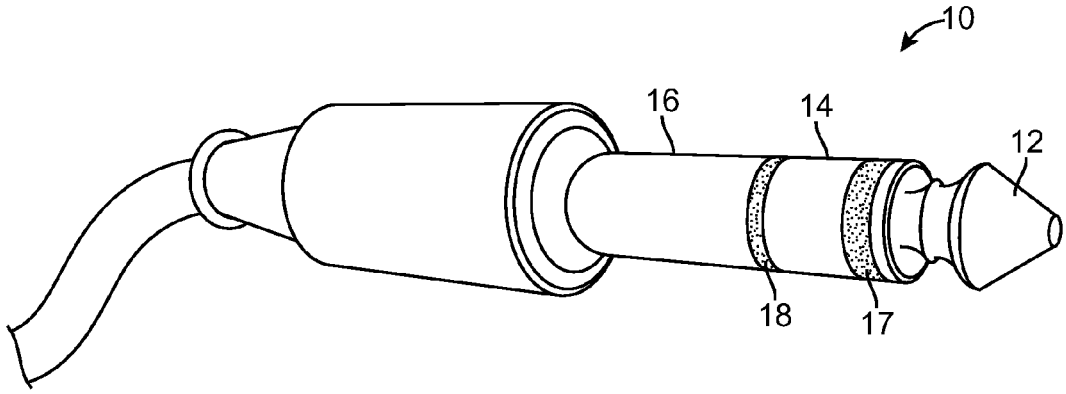
FIGS. 1A and 1B show perspective views of exemplary audio plugs that can be used with a low profile plug receptacle according to embodiments of the invention.
Figure 1B:
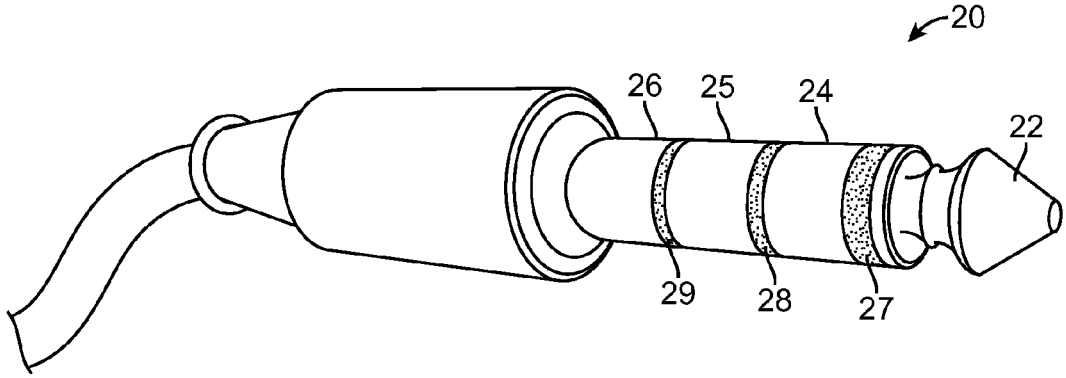
Figure 2:
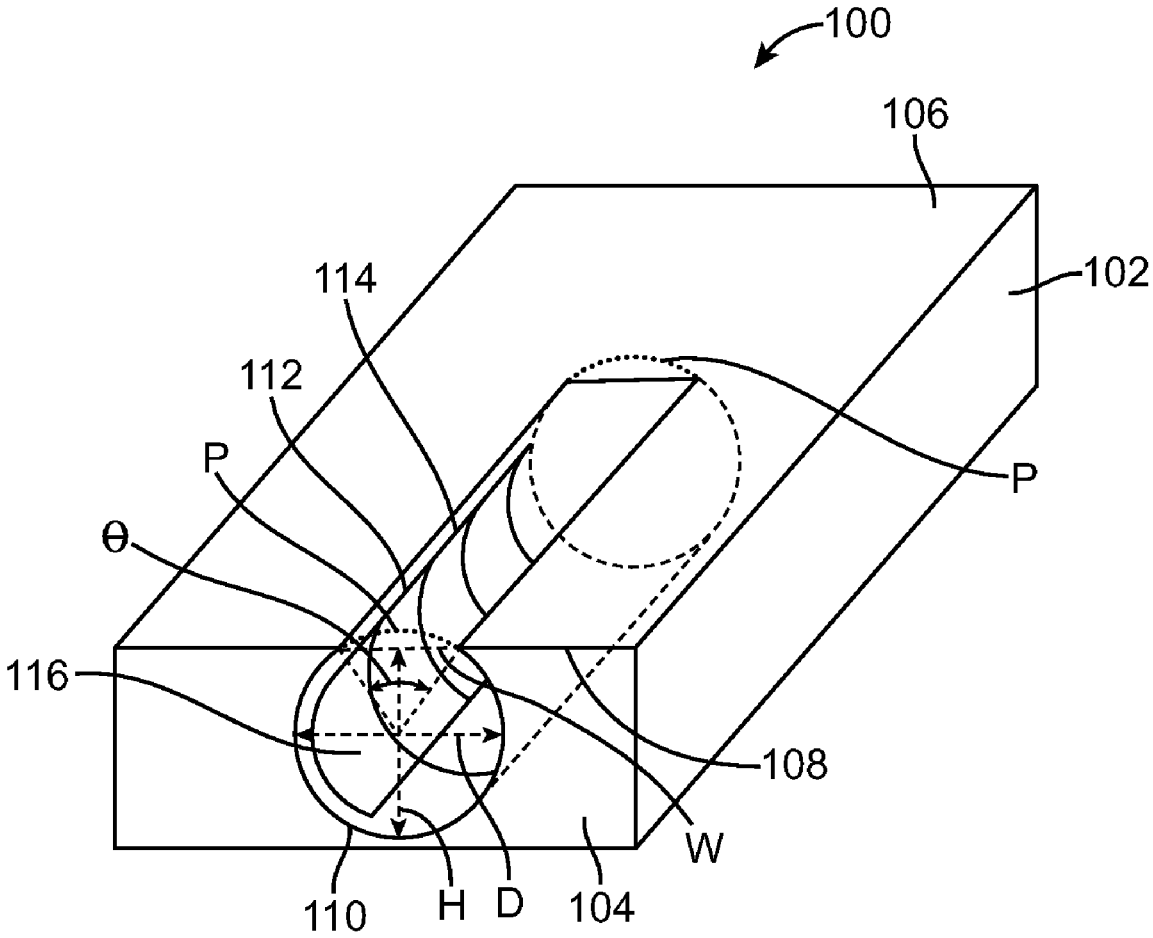
FIG. 2 shows a perspective view of a low profile plug receptacle, according to one embodiment of the invention.

FIG. 2 shows a low profile plug receptacle 100 according to one embodiment of the invention that may be used to provide electrical connections to audio plugs such as audio plugs 10 or 20 shown in FIGS. 1A and 1B or other types of audio plugs. The low profile plug receptacle 100 may include a housing 102. The housing may be constructed from various non-conducting materials, such as plastic. The housing 102 may include a front side 104 and a bottom side 106. The bottom side 106 is arbitrarily named a bottom and may be on any surface of the housing that extends away from front side 104. In the embodiment of FIG. 2, the bottom side 106 shares an edge 108 with the front side 104.

The front side 104 includes a partially circular opening 110, including an angle of opening θ which the angle taken from the center of the circle and the points where circle is abbreviated, e.g. the points on a circle where a chord is present. The center of the angle is taken from the center of the circular opening, or where lines H and D intersect. The opening 110 may have an angle of opening θ less than 180 degrees to ensure that a plug inserted into the opening cannot readily slide out. In some embodiments, the angle of opening θ may be between 55 and 68 degrees. In some embodiments, the angle of opening θ may be between 35 and 88 degrees. The partially circular opening 110 is also disposed on edge 108. The opening 110 is not required to be partially circular, and may be of any shape (e.g. rectangular). The opening 110 may extend into an elongated passage 112 which may be generally cylindrical in shape and longitudinally disposed within the housing 102, as shown.

The bottom side 106 includes an elongated second opening 114 which extends into the elongated passage 112. The second opening 114 includes a width W which may generally be less that the diameter D of the partially circular opening 110. The partially circular opening 110 also includes a height H, which may generally be less that the diameter D, between edge 108 and the furthest interior perimeter of opening 110 directly opposite edge 108.

The elongated passage 112 may include multiple plug receptacle contacts 116 disposed within, which may be spring contacts or other appropriate contacts. The number of contacts 116 may correspond to the type of connector intended to be used with the plug receptacle 100 and depend on the electronic device for which the plug receptacle is used. In one specific embodiment, the plug receptacle contacts may include four individual contacts for ground, left audio channel, right audio channel and video. However, the plug receptacle contacts 116 may include more or less contacts in other embodiments or contacts for different connections altogether. As an example, in one embodiment a fifth contact for a data connection may be used. Additionally, the plug receptacle contacts 116 may be compatible with plugs that include fewer conductive regions than the number of plug receptacle contacts. For example, a plug receptacle having four plug receptacle contacts 116 may be compatible with an audio plug having only three conductive regions for left and right audio channels and a ground contact.

The plug receptacle 100 may be configured to receive any diameter plug, including a standard 3.5 mm or 2.5 mm audio plug, by having its dimensions, including dimensions H and D, scaled accordingly. In one exemplary embodiment in which the receptacle 100 is adapted to be used with 3.5 mm miniature audio plugs, the height H may be less than 3.5 mm, for example 3.3 mm, and the diameter D may be 3.6 mm. In another exemplary embodiment the height H may be 3.4 mm and the diameter D may be 3.6 mm. In an exemplary embodiment in which receptacle 100 is adapted to be used with 2.5 mm subminiature audio plugs, the height H may be 2.2 mm and the diameter D may be 2.55 mm.

In use, an elongated cylindrical plug, e.g. an audio plug such as one of audio plugs 10 or 20 shown in FIGS. 1A and 1B, respectively, may be inserted into the passage 112 through the partially circular opening 110. When inserted the audio plug may partially extend past the second opening 114, as shown by the dotted profile P and thus extend past the bottom side 106.

Low profile plug receptacle 100 is thinner than a standard profile plug receptacle, and thus may be implemented to reduce the thickness of an electronic device. For example the low profile plug receptacle 100 may be placed adjacent to an electronic component such as a display screen while maintaining a thickness which would not otherwise be possible.

Figure 3:
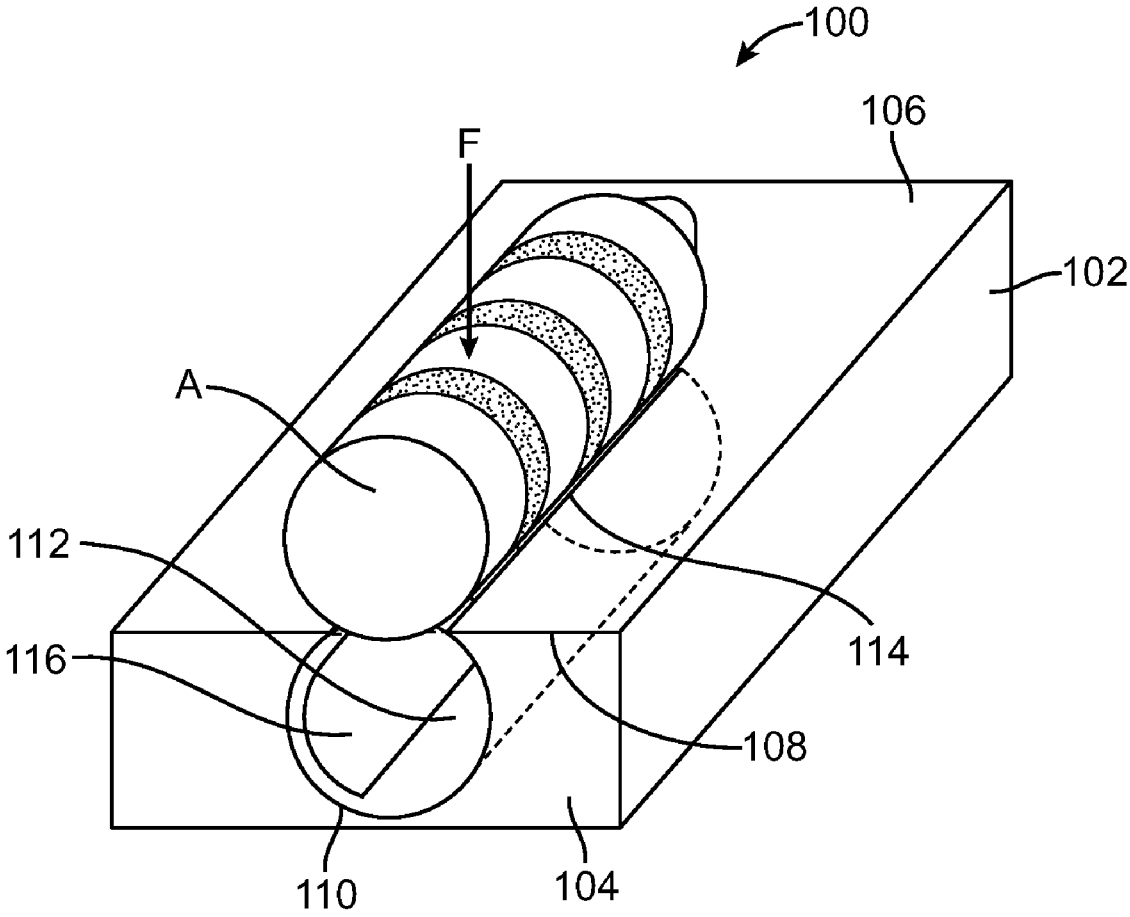
FIG. 3 shows a perspective view of an audio plug being snapped lengthwise into the low profile plug receptacle shown in FIG. 2 according to one embodiment of the invention.

In use, an audio plug may also be "snapped" into the longitudinal passage 112 through the second opening 114. For example the length of an elongated cylindrical plug may be brought into a position parallel and above the longitudinal passage 112 as shown in FIG. 3. When force F is placed on top of the audio plug A, the bottom side 106 may flex enough to allow the audio plug A to be snapped into the longitudinal passage 112. Thus this configuration offers more than one method of inserting an audio plug into the low profile plug receptacle 100. Snapping an audio plug may also be performed in a blind manner because the second opening 114 offers a larger edge for a user to blindly feel in a tactile manner, as compared to a round opening. For example a user may drag a fingernail or finger along an electronic device and easily snap an audio plug into place. Thus the low profile plug receptacle 100 may be used in a tactile manner not offered by the prior art, and without visual guidance. This is particularly advantageous for sight-impaired users or users operating in little or no light. Removal of the audio plug may also be implemented by submitting a force to "pry" out the audio plug.

Figure 4C:
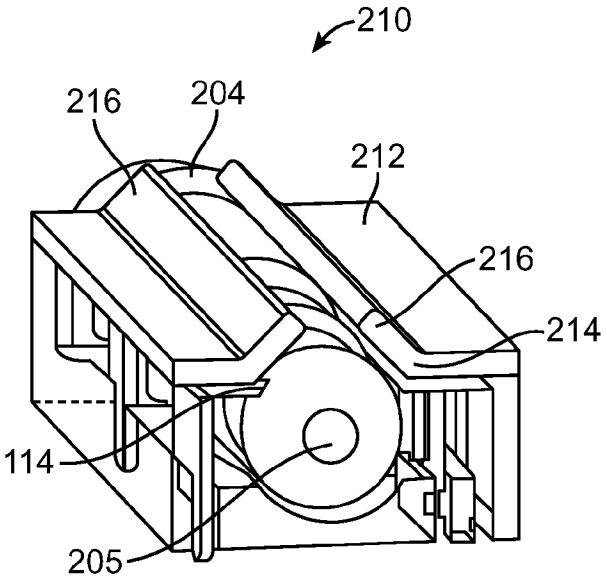
FIG. 4C shows a perspective view of a low profile plug receptacle, according to one embodiment of the invention.
Figure 4B:
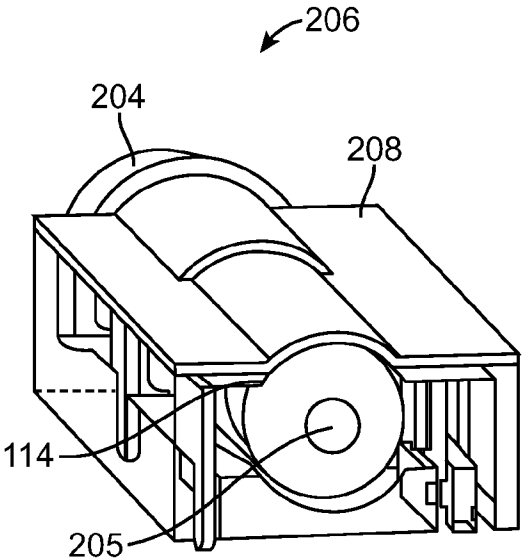
FIG. 4B shows a perspective view of a low profile plug receptacle, according to one embodiment of the invention.
Figure 4A:
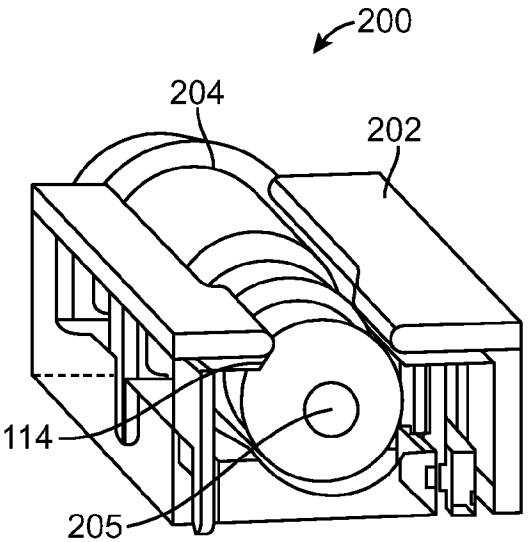
FIG. 4A shows a perspective view of a low profile plug receptacle, according to one embodiment of the invention.

FIGS. 4A-4C show low profile plug receptacles 200, 206 and 210 with an audio plug 204 inserted into the receptacle with its tip 205 extending away from the front surface 104 of the receptacles according to different embodiments of the invention. Each of FIGS. 4A-4C is shown in a perspective, partial cut-away view to more clearly depict and more easily describe various features of the invention. Referring now to FIG. 2A, the low profile plug receptacle 200 may be generally of the same construction as described of the low profile plug receptacle 100 shown in FIG. 1 with the addition of an outer housing 202 that partially surrounds the second opening 114. The outer housing 202 may be constructed from a semi-flexible material which allows a plug 204 to be "snapped" in as described herein, or the outer housing 202 may be constructed from a rigid material that only allows the plug 204 to be inserted into the receptacle through opening 105 (not shown in FIG. 4A). The outer housing 202 may be part of a greater housing of an electronic device, for example the back portion of a portable communications device. The plug 204 is shown to advantageously protrude past the outer housing 202 while simultaneously being captured within the low profile plug receptacle 200. Additionally, a separate or tethered cap (not shown) may be used to cover or plug the low profile plug receptacle 200 when the plug 204 is not inserted to reduce or prevent the influx of dust and other contaminants.

FIG. 4B shows a low profile plug receptacle 206 in use according to another embodiment of the invention. The low profile plug receptacle 206 is generally of the same construction as described of the low profile plug receptacle 100 shown in FIG. 1 with the addition of an outer housing 208, which covers the elongated opening 114. The outer housing 208 may be partially or wholly constructed from a flexible material (e.g. plastic, foam, rubber or the like) that elastically deforms when a plug 204 is inserted, as shown. The outer housing 208 may return to a flat shape when plug 204 is removed. The outer housing 208 may also be part of a greater housing of an electronic device, for example the back portion of a portable communications device. The plug 204 is shown to advantageously elastically deform the outer housing 202 while simultaneously being captured within the low profile plug receptacle 206. This configuration provides a low profile connector arrangement that also reduces or prevents influx of dust and other contaminants.

FIG. 4C shows a low profile plug receptacle 210 in use according to still another embodiment of the invention. The low profile plug receptacle 210 is generally of the same construction as described of the low profile plug receptacle 100 shown in FIG. 1 with the addition of an outer housing 212 that hinges to cover and expose elongated opening 114. The outer housing 212 may be partially or wholly constructed from a flexible material (e.g. plastic, foam, rubber) which elastically deforms at a hinged region 214 when a plug 204 is inserted, as shown. The hinged region 214 may include attributes (e.g. thinner wall thickness, holes) to preferentially hinge at the hinged region 214. The outer housing 212 may also be of a rigid material which includes mechanical hinges at region 214. The hinged region 214 may spring biased using actual springs or by relying on elastic material properties to preferentially close when plug 204 is not present. The outer housing 212 is shown to include two doors 216, but may only include a single door 216 in other embodiments. The two doors 216 may be normally closed when plug 204 is not present, and forced open by the insertion of plug 204. The outer housing 212 may also be part of a greater housing of an electronic device, for example, the back portion of a portable communications device. The plug 204 is advantageously shown to elastically deform or open the outer housing 212 while simultaneously being captured within the low profile plug receptacle 210. Similar to the embodiment of FIG. 4B, profile plug receptacle 210 also provides a low profile connector arrangement that reduces or prevents influx of dust and other contaminants.

Figure 5:
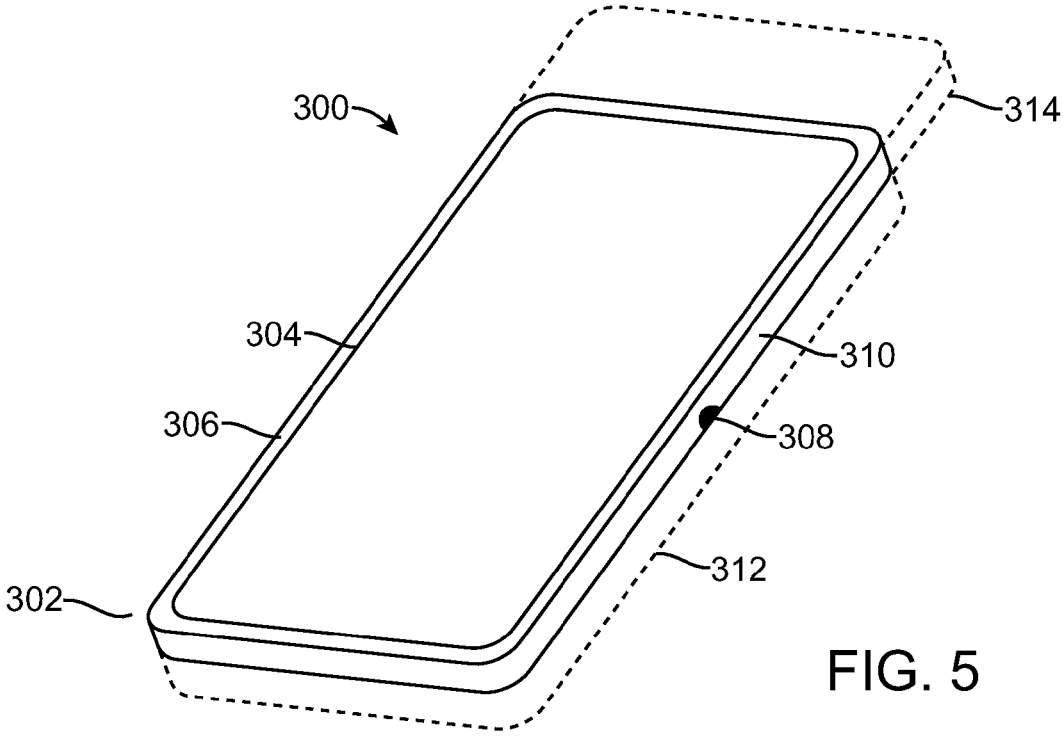
FIG. 5 shows a perspective view of an electronic device, according to one embodiment of the invention.

FIG. 5 shows an electronic device 300, according to one embodiment of the invention. The electronic device 300 may be a portable electronic communication or media device such as the iPhone 3G®, iPod touch®, and iPod nano® manufactured by Apple Inc. It has been found that for devices less than 5 mm thick a standard 3.5 mm receptacle cannot be used. Accordingly a low profile 3.5 mm receptacle may be implemented on devices less than 5 mm with success. The electronic device 300 may include one or more processors, communications buses and memories (not shown). The electronic device 300 may operate as a mobile phone and/or a media playing/recording device. The electronic device 300 may include a housing 302 which includes a display screen 304 on a top side 306. The display screen 304 may be a touch screen. The electronic device 300 may include a low profile plug receptacle 308 on a side 310 of the electronic device. The side 310 may be 5 mm thick or less. The low profile plug receptacle 308 may share the general construction of the low profile plug receptacles described herein. The configuration of the low profile plug receptacle 308 is advantageous because it is vertically stacked inline with the display panel 304. Prior art configurations required the electronic device 300 to either be thicker as shown by dotted section 312, or include a separate zone as shown by dotted zone 314.

As will be understood by those skilled in the art, the present invention may be embodied in other specific forms without departing from the essential characteristics thereof. Those skilled in the art will recognize, or be able to ascertain using no more than routine experimentation, many equivalents to the specific embodiments of the invention described herein. Such equivalents are intended to be encompassed by the following claims.

What is claimed is:

1. A low profile plug receptacle, comprising:

a connector housing including at least a front side and a bottom side, the front side including a partially circular opening which extends into a longitudinal passage inside the connector housing, the bottom side being perpendicular to the front side and including a second opening which extends into the longitudinal passage, the second opening having a width which is smaller than the diameter of the partially circular opening, the connector housing being compatible with an elongated cylindrical plug which extends partially through the second opening when inserted into the connector housing; and a plurality of plug receptacle contacts within the longitudinal passage.

2. The low profile plug receptacle of claim 1 further comprising a flexible housing which at least partially covers the second opening.

3. The low profile plug receptacle of claim 2 wherein the flexible housing elastically deforms expanding outward when the elongated cylindrical plug is inserted into the longitudinal passage.

4. The low profile plug receptacle of claim 1 further comprising a hinged housing which at least partially covers the second opening and hinges away from the longitudinal passage when the elongated cylindrical plug is inserted into the longitudinal passage.

5. The low profile plug receptacle of claim 4 wherein the hinged housing elastically deforms at a hinged region when the elongated cylindrical plug is inserted into the longitudinal passage.

6. The low profile plug receptacle of claim 4 wherein the hinged housing hinges at a mechanical hinge.

7. The low profile plug receptacle of claim 4 wherein the hinged housing comprises two hinged doors that open when the elongated cylindrical plug is inserted into the longitudinal passage.

8. The low profile plug receptacle of claim 7 wherein the hinged doors rest against the elongated cylindrical plug when the plug is positioned within the longitudinal passage.

9. The low profile plug receptacle of claim 1 further comprising an outer housing wherein a portion of the outer housing surrounding the second opening is sufficiently flexible to allow the elongated cylindrical plug to be snapped in and out through the second opening.

10. The low profile plug receptacle of claim 1 wherein the connector housing including the partially circular opening and longitudinal passage is configured to receive a 3.5 mm plug.

11. The low profile plug receptacle of claim 10 wherein the partially circular opening has a height less than 3.4 mm.

12. The low profile plug receptacle of claim 1 wherein the connector housing including the partially circular opening is configured to receive a 2.5 mm plug.

13. The low profile plug receptacle of claim 1 wherein the plurality of plug receptacle contacts comprise a ground contact, first and second audio contacts, and a video contact.

14. The low profile plug receptacle of claim 13 wherein the plurality of plug receptacle contacts are compatible with a plug that consists of three contacts including a ground contact and first and second audio contacts.

15. The low profile plug receptacle of claim 1 wherein the plurality of plug receptacle contacts are spring contacts.

16. A low profile plug receptacle, comprising:

a connector housing including at least a front side and a bottom side, the front side including a partially circular opening having an angle of opening less than 180 degrees which is open at an edge shared between the bottom side and front side and opens into a longitudinal passage inside the connector housing, the bottom side including a second opening which is open at the edge shared between the bottom side and the front side and opens into the longitudinal passage; and a plurality of plug receptacle contacts within the longitudinal passage.

17. The low profile plug receptacle of claim 16 wherein the connector housing is adapted to have an elongated cylindrical plug having a diameter larger than the width of the second opening and a plurality of electrically isolated conductive regions formed thereon inserted into the longitudinal passage such that, when the elongated cylindrical plug is inserted into the longitudinal passage, the plurality of electrical conductive regions of the plug align with and electrically couple to the plurality of plug receptacle contacts and a portion of the elongated cylindrical plug extends partially through the second opening.

18. The low profile plug receptacle of claim 17 wherein the second opening is an elongated opening having a width smaller than the diameter of the partially circular opening.

19. The low profile plug receptacle of claim 17 wherein the angle of opening of the partially circular opening is between 35-88 degrees.

20. The low profile plug receptacle of claim 19 wherein the audio plug receptacle contacts are configured to operably couple to a 3.5 mm plug.

21. The low profile plug receptacle of claim 20 wherein the partially circular opening includes a diameter of about 3.6 mm and a height of less than 3.4 mm.

22. The low profile plug receptacle of claim 19 wherein the audio plug receptacle contacts are configured to operably couple to a 2.5 mm plug.

23. The low profile plug receptacle of claim 19 wherein the plurality of contacts comprises a ground contact, first and second audio contacts, and a video contact.

24. The low profile plug receptacle of claim 19 wherein the plurality of plug receptacle contacts are spring contacts.

25. A portable electronic device, comprising:

a device housing including a front side, top side, and a bottom side, the front side including a partially circular opening which extends into a longitudinal passage inside the device housing, the bottom side including a second opening which extends into the longitudinal passage, the second opening having a width which is smaller than the diameter of the partially circular opening, the connector housing being compatible with an elongated cylindrical plug which extends partially through the second opening when inserted into the longitudinal passage;

a plurality of plug receptacle contacts within the longitudinal passage; and a display panel on the top side of the housing, wherein a portion of the display panel is vertically stacked inline with the plurality of plug receptacles.

26. The portable electronic device of claim 25 further comprising a flexible housing which at least partially covers the second opening.

27. The portable electronic device of claim 25 wherein the audio plug receptacle contacts are configured to receive a 3.5 mm plug.

28. A low profile plug receptacle for a 3.5 mm audio plug, the receptacle comprising:

a connector housing including at least a front side and a bottom side, the front side including a partially circular opening which extends into a longitudinal passage inside the connector housing, the partially circular opening having a height between a furthest point on an interior perimeter of the opening and the bottom side less than 3.5 mm, the bottom side including a second opening which extends into the longitudinal passage, the second opening having a width which is smaller than the diameter of the partially circular opening, the connector housing being compatible with a 3.5 mm audio plug which extends partially through the second opening when inserted into the longitudinal passage of the connector housing;

a plurality of plug receptacle contacts within the longitudinal passage, the plurality of plug receptacle contacts comprising a ground contact, first and second audio contacts and a video contact; and a flexible door which at least partially covers the second opening and opens away from the longitudinal passage by insertion of the 3.5 mm audio plug into the longitudinal passage and closes toward the longitudinal passage when the 3.5 mm audio plug is removed.

29. The low profile 3.5 mm plug receptacle of claim 28 wherein the plurality of plug receptacle contacts are spring contacts.

* * * * *